US005199543A

United States Patent [19]

Kamagami et al.

[11] Patent Number: 5,199,543

[45] Date of Patent: Apr. 6, 1993

[54] APPARATUS FOR AND METHOD OF DISCRIMINATING BILL

[75] Inventors: Shinya Kamagami; Takashi Yajima; Ienobu Takizawa, all of Tokyo, Japan

[73] Assignee: Oki Electric Industry Co., Ltd., Tokyo, Japan

[21] Appl. No.: 747,707

[22] Filed: Aug. 20, 1991

[30] Foreign Application Priority Data

Aug. 22, 1990 [JP] Japan ..... 2-219078
Nov. 16, 1990 [JP] Japan ..... 2-308654

[51] Int. Cl.[5] ..... G07D 7/00

[52] U.S. Cl. ..... 194/207; 209/534; 356/71; 382/7

[58] Field of Search ..... 194/206, 207; 205/534; 382/7, 50; 356/71, 394

[56] References Cited

U.S. PATENT DOCUMENTS 4,464,786 8/1984 Nishito et al. ..... 382/7
4,487,306 12/1984 Nao et al. ..... 194/207
4,542,829 9/1985 Emery et al. ..... 205/534

*Primary Examiner*—F. J. Bartuska
*Attorney, Agent, or Firm*—Spencer, Frank & Schneider

[57] ABSTRACT

A bill discriminating device includes sensor circuitry for scanning and reading all the printed patterns of a bill to be discriminated and producing discriminated data including bill scale data, the bill scale data representing the density of the printed patterns. A data storage memory stores the discriminated data including the bill scale data from the sensor circuitry. A bill scale data selector selects the bill scale data from the discriminated data and fetches the selected bill scale data from the data storage memory. A data segmentor segments the thus selected and fetched bill scale data into a plurality of blocks of data. An arithmetic unit subjects the segmented bill scale data to an arithmetic averaging process for each block of data. A reference data storage memory stores reference data for each of a plurality of predetermined reference bills. Bill decision circuitry reads each reference data from the reference data storage memory and compares each block of the bill scale data which was subjected to an arithmetic averaging process with each reference data.

13 Claims, 17 Drawing Sheets

Fig. 5

| | XX00 | XX01 | XX02 | XX03 | XX04 | XXFC | XXFD | XXFE | XXFF |
|---|---|---|---|---|---|---|---|---|---|
| 00XX | 00 | 00 | 00 | 00 | 00 | 00 | 00 | 00 | 00 |
| 01XX | 00 | 00 | 00 | 00 | 00 | 00 | 00 | 00 | 00 |
| 02XX | 00 | 00 | 00 | 00 | 00 | 00 | 00 | 00 | 00 |
| 03XX | 00 | 00 | BA | C7 | C6 | 00 | 00 | 00 | 00 |
| 04XX | 00 | 00 | C9 | C2 | C2 | C1 | C8 | 00 | 00 |
| 05XX | 00 | 00 | C0 | BE | C0 | C2 | BE | 00 | 00 |
| ---------- | | | | | | | | | |
| FAXX | 00 | C2 | BD | BE | CA | C4 | 00 | 00 | 00 |
| FBXX | 00 | C8 | B7 | C1 | C7 | C1 | 00 | 00 | 00 |
| FCXX | 00 | CA | B9 | C4 | C1 | C8 | 00 | 00 | 00 |
| FDXX | 00 | 00 | 00 | 00 | 00 | BF | 00 | 00 | 00 |
| FEXX | 00 | 00 | 00 | 00 | 00 | 00 | 00 | 00 | 00 |
| FFXX | 00 | 00 | 00 | 00 | 00 | 00 | 00 | 00 | 00 |

Fig. 7

| PATTERN / AREA | $S_{1n}-D_n$ | $S_{2n}-D_n$ | $S_{3n}-D_n$ | $S_{4n}-D_n$ | $S_{12}-D_n$ |
|---|---|---|---|---|---|
| n = 1 | 5H | 3H | 0H | 2H | 6H |
| n = 2 | 7H | AH | 1H | CH | 5H |
| n = 3 | AH | 0H | 0H | 3H | AH |
| n = 4 | 4H | 2H | 2H | 4H | 2H |
| ---------- | | | | | |
| n = 15 | 2H | 4H | 0H | 1H | AH |
| n = 16 | CH | 6H | 0H | 4H | CH |
| GK | 84H | 52H | 07H | 43H | 98H |

Fig. 10

| | Z1 (n) | Z2 (n) | Z3 (n) | | Z12 (n) |
|---|---|---|---|---|---|
| n = 1 | 598H | C5AH | 48H | | 486H |
| n = 2 | 14CH | 894H | 69H | | 694H |
| n = 3 | 94DH | 3C5H | 2BH | | 1B5H |
| | | | | | |
| n = 15 | D5H | 263H | 25H | | 641H |
| n = 16 | 49AH | 351H | 4FH | | B53H |
| DK | 2765H | 2FD0H | 27AH | | 26E2H |

| | RESULTANT OPERATION OF ADDED VALUE R3n | REFERENCE DATA | DECISION |
|---|---|---|---|
| R31 | 138H | 189H | OK |
| R32 | 194H | 239H | OK |
| R33 | F3H | 156H | OK |
| R34 | 124H | 1A0H | OK |
| R35 | 203H | 240H | OK |
| R36 | 1A3H | 21AH | OK |
| | | | |
| R316 | 157H | 23DH | OK |

Fig. 18

| | ARITHMETIC OPERATIONAL RESULT OF DISCRIMINATED BILL | REFERENCE VALUE | DECISION |
|---|---|---|---|
| Sa | 16A H | 212 H | OK |
| Sb | 2D5 H | 586 H | OK |
| Sc | SC5 H | 410 H | OK |
| Sd | 140 H | 390 H | OK |
| Se | 278 H | 492 H | OK |
| Sf | 0FD H | 235 H | OK |
| Sg | 138 H | 3C3 H | OK |
| Sh | 1DB H | 2B5 H | OK |
| | FINAL DECISION | | OK |

Fig. 19

| | ARITHMETIC OPERATIONAL RESULT OF DISCRIMINATED BILL | REFERENCE VALUE | DECISION |
|---|---|---|---|
| Sa | 124 H | 212 H | OK |
| Sb | 386 H | 586 H | OK |
| Sc | 435 H | 410 H | NG |
| Sd | 2BF H | 390 H | OK |
| Se | 37C H | 492 H | OK |
| Sf | 198 H | 235 H | OK H |
| Sg | 2DE H | 3C3 H | OK |
| Sh | 1A9 H | 2B5 H | OK |
| | FINAL DECISION | | Rj |

APPARATUS FOR AND METHOD OF DISCRIMINATING BILL

BACKGROUND OF THE INVENTION

1. Field of the Invention

The present invention relates to an automatic cash dispenser installed in a banking system, and particularly to an apparatus for and a method of discriminating denominations and authenticity of banking bills (hereinafter referred to as bills).

2. Description of the Related Art

A typical cash dispenser has a bill discriminating apparatus for discriminating denominations of and authenticity of bills deposited by customers or for ascertaining denominations of and authenticity of bills to be drawn by the customers.

The bill discriminating apparatus of this type has a sensor disposed opposite to a bill which travels in the cash dispenser and is to be discriminated (hereinafter referred to as discriminated note) for ascertaining the genuineness of bills. The sensor includes a magnetic sensor for detecting a mangetic property of magnetized ink employed in the discriminated bill.

The sensor first detects one side of the bill, i.e. a face or a back, in the vertical direction relative to the traveling direction of the bill (main scanning direction) and thereafter in the lateral direction relative to the traveling direction as the bill travels further (auxiliary scanning direction), thereby reading an entire printed pattern of the bill to extract therefrom the printed pattern in a specific area which is determined by the traveling direction.

The thus read printed pattern in the specific area is converted by the sensor into an electrical signal which varies in amplitude. The electrical signal has a characteristic value depending on the difference between the denomination of bills and the traveling directions of the bills.

The sensor comprises an image sensor or the like and outputs a continuous analog signal which varies in amplitude as the discriminated bill travels. The analog signal is sampled for a predetermined time interval and converted into a digital signal by an A/D converter. Consequently, a plurality of digital scale data (data signal to be discriminated, hereinafter referred to as discriminated signal) are produced in every discriminated bill depending on the read electrical signals.

The bill disciminating apparatus has stared standard pattern signals to be compared with the discriminated data signal. The standard pattern signals have upper and lower limit values. The bill discriminating apparatus compares the discriminated data signals with the standard pattern signals to see that they are within the upper and lower limit values and carries out an arithmetic operation based on the result, which has been obtained at many sampling points, thereby discriminating the denomination of bills and the traveling direction.

The standard pattern signal is typically produced in the following manner.

First, the sensor reads a plurality of printed patterns of genuine bills and collects electrical signals corresponding to the read printed pattern.

Even in the same denominations of bills, the scanning area is differentiated in the case where the traveling bill confronts the sensor at the left side of the face thereof and in the case where the traveling bill confronts the sensor at the right side of the face thereof, whereby the standard pattern is differentiated. In the case of the back of the bill, it is same as in the case of the front of the bill. Accordingly, since there are three denominations of the Bank of Japan bill, i.e., 10,000-yen bill, 5,000-yen bill and 1,000-yen bill, four denominations of standard pattern signals are determined for each denomination of bill, considering the face of the bill, i.e. denomination, the back of the bill and the traveling direction.

However, the selection of an optimum scanning area in every bill required much time and labor since it was necessary to collect an extensive amount of printing data in every face, back and traveling direction.

If the printing data is obtained merely from a less soiled genuine bill, a genuine bill is liable to be often rejected as a false bill since the discriminating standard becomes strict.

Furthermore, inasmuch as the picture element of the image sensor employed in the sensor is very minute, the scanning line in the main scanning direction is subsegmented while the scanning line in the auxiliary scanning direction becomes a continuous line since ordinary bills have printed shear or crumple thereof, the detected data is liable to scatter widely since it is difficut to obtain the same auxiliary line at all times when the auxiliary scanning lines are minute.

If the authenticity or the denomination of bill is discriminated on the basis of the widely scattered data and the previously prepared standard pattern, the discrimination accuracy is deteriorates.

Furthermore, the discriminated data signal has to be collated with many standard pattern signals to improve the discriminating accuracy based on such data. As a result, such a discriminator collation takes much time for collation and requires a large storage capacity to store many standard pattern signals.

SUMMARY OF THE INVENTION

It is an object of the present invention to provide a bill discriminating apparatus capable of discriminating denominations, traveling direction and authenticiy of bills with high accuracy without the need for collecting and analyzing an extensive amount of data.

It is another object of the present invention to provide a bill discriminating apparatus capable of discriminating kinds, traveling direction and authenticity of bills with high accuracy and without being severely influenced by a printing shear or shrinkage of a bill or displacement of scanning patterns.

It is further object of the present invention to provide a bill discriminating apparatus capable of processing a collation (comparison) with standard data at high speed.

To achieve the above objects, the bill discriminating apparatus according to the present invention comprises a sensor for reading every denomination of a printed pattern of a discriminated bill and a data memory for storing a discriminated data including a bill scale data representing color density (tone) of each pixel obtained by the sensor characterized in that the bill discriminating apparatus further comprises:

a bill scale data selection means for retrieving and fetching the bill scale data based on the discriminated bill data, data segmenting means for segmenting the set bill scale data into a plurality of block areas, a data arithmetic means for subjecting the segmented scale data to the arithmetic process in every block area, a standard data storage means for storing each predetermined standard operation data in every bill, and a bill decision means for reading each standard data from the standard data storage means and collating the operation data which was subjected to the arithmetic process in every block area with the standard arithmetic data.

BRIEF DESCRIPTION OF THE DRAWINGS

FIG. 5 is a view showing a state of storage of a discriminated data stored in a data storage memory, a constituent of the bill discriminating apparatus in FIG. 1;

FIG. 7 is a view showing an arithmetic result in every block area in FIG. 6;

FIG. 10 is a view showing an arithmetic result in every block area;

FIGS. 18 and 19 are views showing results of arithmetic operations by a genuineness decision means.

DESCRIPTION OF THE PREFERRED EMBODIMENT

First Embodiment (FIGS. 1 to 7)

Figure 1:
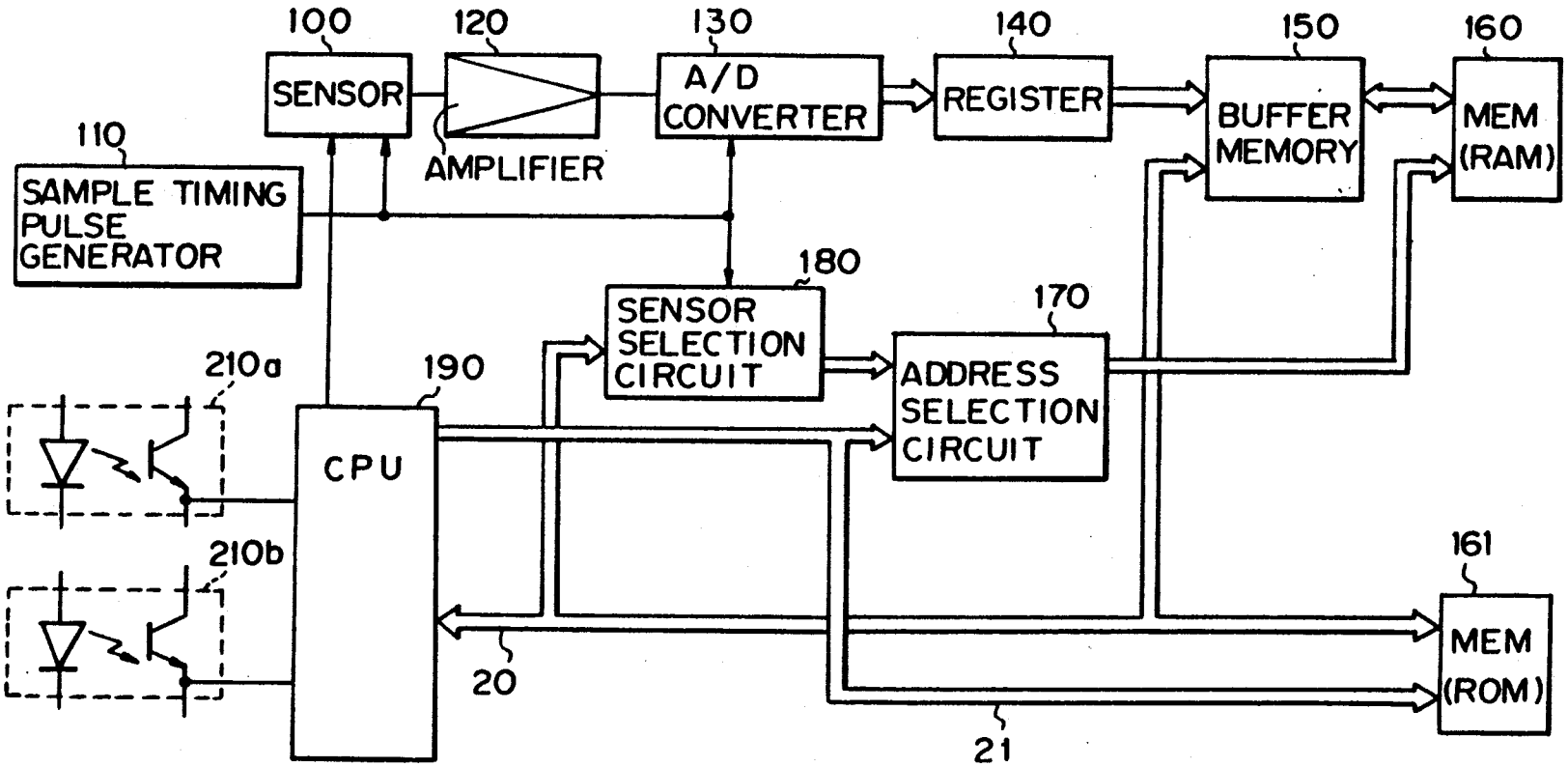
FIG. 1 is a block diagram of a bill discriminating apparatus according to a first embodiment of the present invention.

A bill discriminating appartaus according to a first embodiment of the present invention will be described with reference to FIG. 1.

Figure 2:
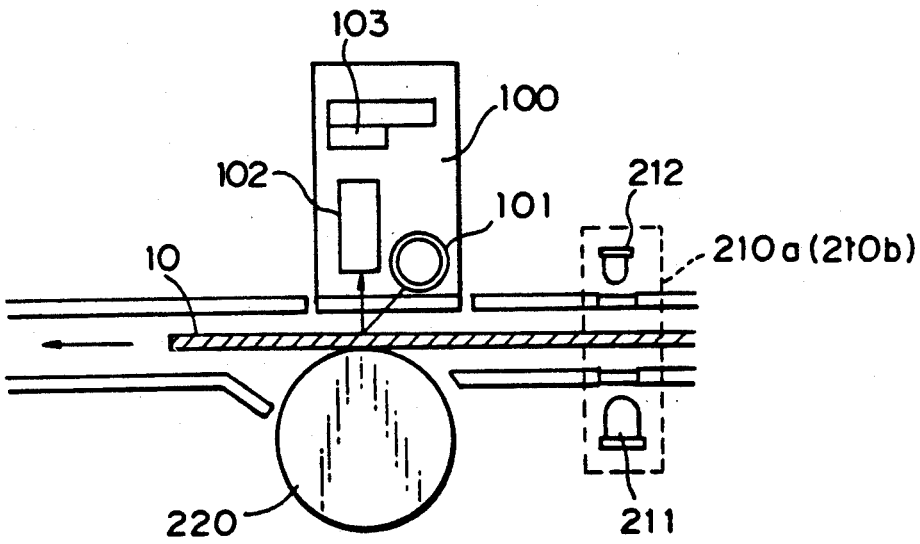
FIG. 2 is a view showing an arrangement of a sensor, a constituent of the bill discriminating apparatus in FIG. 1.

A sensor 100 for reading a one-dimensional image reads a printed pattern of a discriminated bill 10, described in FIG. 2, upon reception of a sample clock generated by a sample timing pulse generator 110. An analog signal (scale data) is produced by the sensor 100, and amplified by an amplifier 120 to an optimum value. The amplified signal is converted into a digital data (discriminated data) by an A/D converter 130. The discriminated data is temporarily stored in a register 140 and thereafter stored in a buffer memory 150. The discriminated data stored in the buffer memory 150 is stored in a data storage memory 160 on the basis of an address specified by an address selection circuit 170. The data storage memory 160 comprises a static ram (SRAM). The address selection circuit 170 is connected to a sensor selection circuit 180. The sensor selection circuit 180 supplies an address corresponding to a sensor selected by the sensor 100 to the address selection circuit 170. The sensor selection circuit 180 is connected to a central processing unit (CPU) 190 by way of a data bus 20 while the address selection circuit 170 is connected to the CPU 190 by way of an address bus 21. The CPU 190 is connected to a control data storage memory 160 by way of the data bus 20 and the address bus 21. The control data storage memory 161 comprises a read only memory (ROM) and stores a program for controlling an operation of the CPU or performing an arithmetic operation described later.

The sensor will be described more in detail with reference to FIG. 2.

The sensor 100 comprises two pairs of transparent type sensors 210*a* and 210*b* (refer to FIG. 1) for detecting the travel of the discriminated bill 10. The transparent type sensors 210*a* and 210*b* comprise light emitting diodes (LED) 211 as a light source emitting device and phototransistors 212 as a photo-detector for producing a read start signal to the CPU 190. The sensor 100 has an LED array 101 and the emitted light is reflected from the discriminated bill 10 and applied to a Rod lens array 102. An incident light received by the Rod lens array 102 is received by one-dimentional image sensor 103. The image sensor 103 is connected to the amplifier 120 as shown in FIG. 1.

A carrier roler 220 is disposed under the sensor 100 for transport the discriminated bill 10. The carrier roller 220 has a black or blakish periphery for keeping reflectance of the light emitted by the LED array 101 at a minimum.

Figure 3:
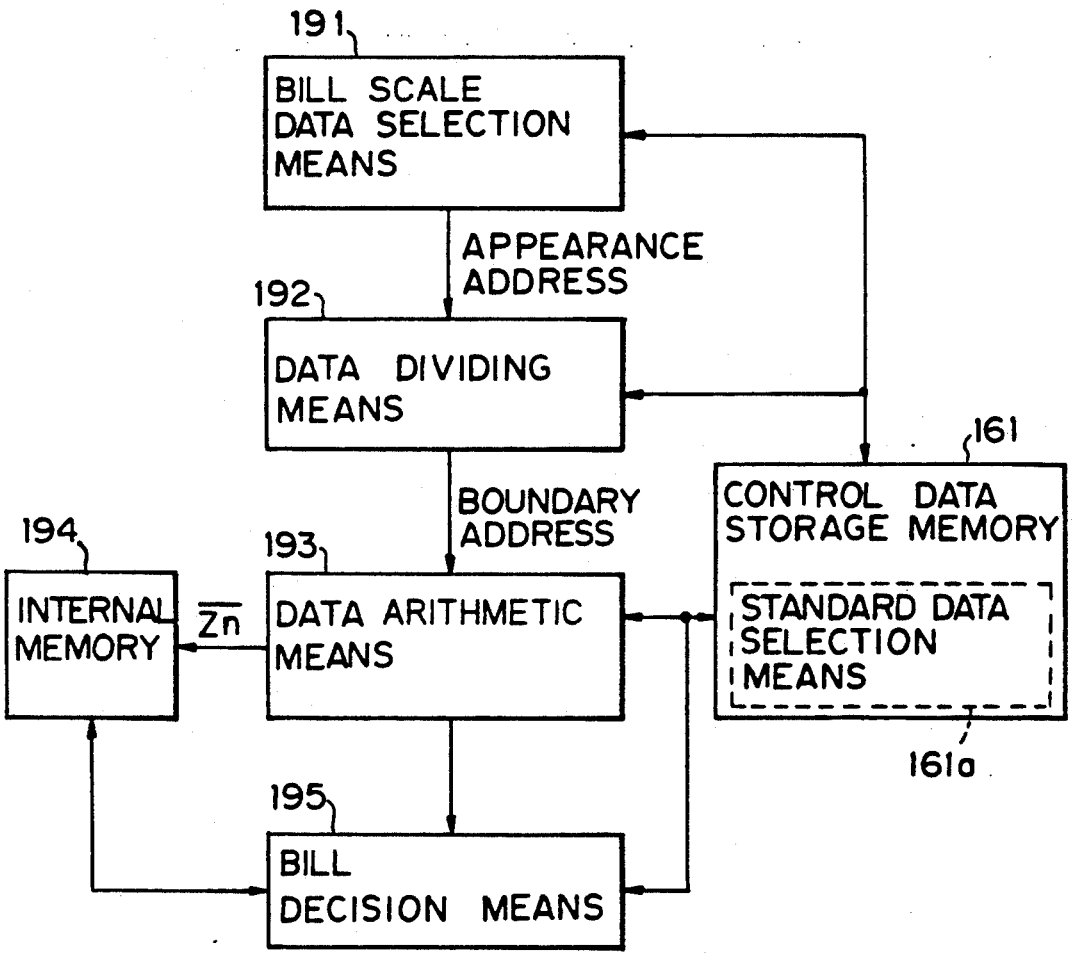
FIG. 3 is a block diagram showing a function of a CPU for discriminating denominations and traveling directions of a bill.

The CPU 190 will be described more in detail with reference to FIG. 3.

Bill scale data selection means 191 retrieves and fetches a bill scale data alone among the discriminated data obtained by the sensor. That is, thee discriminated data read by the sensor 100 comprises a combination of useless data read by the light reflected by the carrier roller 220 and the bill scale data representing the tone of each pixel read from the printed pattern of the discriminated bill 10. The bill scale data selection means 191 retrieves the data storage memory 160 based on a digital slice value, described later, for selecting an appearance address where the bill scale data exceeding the digital slice value is stored.

Data segmenting means 192 performs an arithmetic operation, described later, based on the appearance address selected by the bill scale data selection means 191 and divides the bill scale data uniformly into a plurality of block areas. That is, according to the first embodiment of the present invention, one side of the discriminated bill 10 is segmented uniformly into sixteen block areas in which boundaries in each block area are indicated by a boundary address.

Data arithmetic means 193 fetches segmented scale data in each block area based on the boundary address and performs an arithmetic operation for the segmented scale data in each block area based on a given arithmetic method. A result of operation in each block area is stored in an internal memory 194.

A bill decision means 195 reads standard data which is differentiated in each block area depending on denominations of bills from a standard data storage portion 161*a* of the control data storage memory 161 and calculates the difference between the standard data in each block area and the result of the operation performed by the data operation means 193, and totals an absolute value thereof. The bill decision means 195 decides that the bill having a least totaled difference value is a denomination of the discriminated bill 10. However, the bill decision means 195 decides that the bill having a totaled difference value which is greater than a predetermined level is a false bill.

Figure 4:
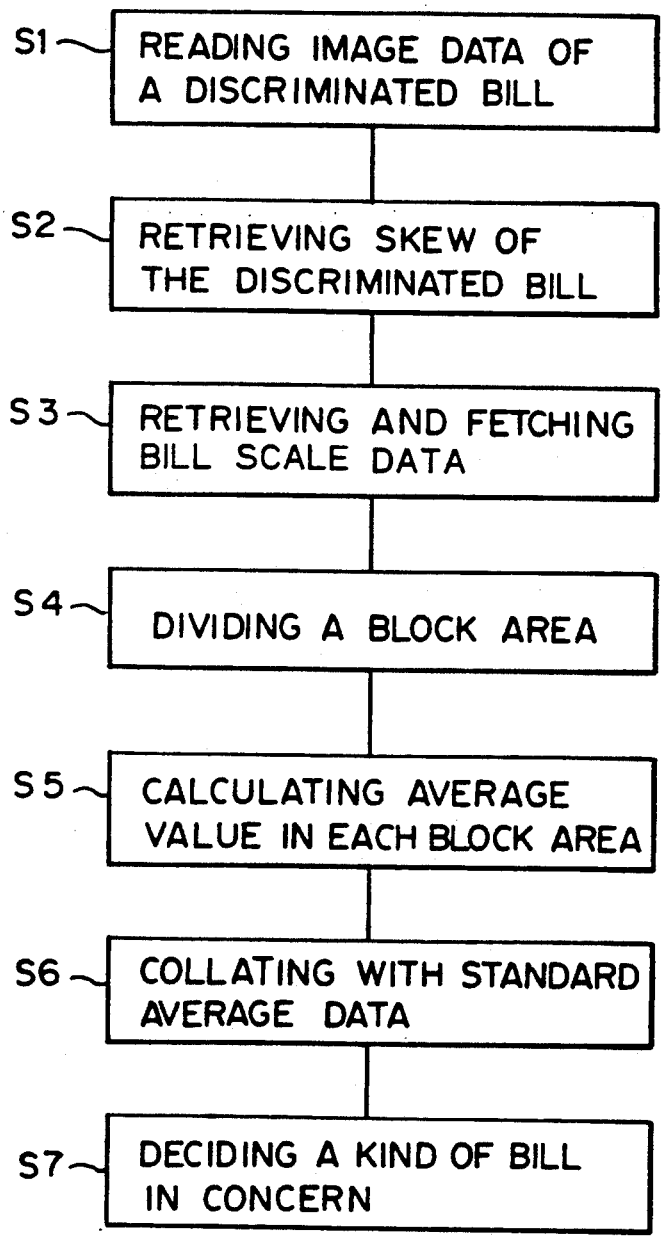
FIG. 4 is a flow chart showing ar operation of the bill discriminating apparatus in FIG. 1 for discriminating denominations and traveling directions of the bill.

An operation of the bill discriminating apparatus will be described with reference to FIG. 4.

When the discriminated bill 10 is delivered into a travel route while one of the photo-transistors 212 does not receive the light from the light emitting diode 211, the photo-transistor 212 supplies a detection signal to the CPU 190. When the CPU 190 receives the detection signal, it operates the sensor 100 and the carrier roller 220. Accordingly, as the discriminated bill 10 travels, the printed pattern of the bill 10 is read while the sensor 200 produces the analog discriminated signal (step S1).

The discriminated signal is amplified by the amplifier 120 to an optimum value and thereafter converted by the A/D converter 130 into the digital signal (decision data). The decision data are stored to the register 140 as they are.

The sensor selection circuit 180 supplies an address corresponding to a pixel of the image sensor 103 to the address selection circuit 170 every time it selects the pixel of the image sensor 103 of the sensor 100 under the control of the CPU 190. Whereupon the address selection circuit 170, upon reception of the afore-mentioned address, gains access directly to the data storage memory 160 and specifies the storage address. Accordingly, inasmuch as the CPU 190 does not gain access to the data storage memory 160, the decision data of the register 140 can be stored in the data storage memory 160 through the buffer memory 150 in a short time.

Whereupon, assuming that the number of pixels in the main scanning direction by the image sensor of the sensor 200 is 256, the decision data is stored in the data storage memory 160 in addresses $XX00_H$ to $XXFF_H$ as illustrated in FIG. 5. Assuming that the number of scans is 256 per area of the discriminated bill 10 in the auxiliary scanning direction, the decision data is stored in the data storage memory 160 in addresses $00XX_H$ to $FFXX_H$. That is, the decision data of the descriminated bill 10 is stored in the storage memory 160 in addresses $0000_H$ to $FFFF_H$. Assuming that the scale data per pixel is one byte, the number of the decision data for an entire printed pattern of the discriminated bill 10 and a peripheral surface pattern of the carrier roller 220 is 64 K bytes.

When the decision data is stored completely into the data storage memory 160, the CPU 190 gains access to the control data storage memory 161, thereby reading the selection control program. The bill scale data selection means 191 selects the appearance address of the bill scale data included in the decision data based on the digital slice value with use of the selection control program. The digital slice value is set to be $40_H$ according to the first embodiment of the present embodiment. That is, since the print is not subjected to an edge of the discriminated bill 10, it has a large reflectance while the peripheral surface of the traveling roller 220 has a small reflectance since it is black or blackish. Accordingly, suppose that the digital slice value is set to be $40_H$, the bill decision means 195 decides that the discriminated bill is in the edge if the value of the decision data are greater than 40H.

The bill scale data selection means 191 judges that the discriminated bill travels askew so as to lead at the left side thereof when the left side phototransistor 212 produces the detected signal at first. The bill scale data selection means 191 controls the address selection circuit 170 in step 3 and supplies the addresses $FF00_H$, $FE00_H$, . . . $0000_H$, $FF01_H$, $FE01_H$, . . . successively to the data storage memory 160. As a consequence, each pixel data is supplied to CPU 190 by way of the buffer memory 150 and the data bus 20 in the order of thus read addresses from the data memory 160. The data selection means 191 compares each pixel data with the digital slice value $40_H$, thereby detecting addresses corresponding to the pixel data exceeding the slice value. According to the first embodiment of the present invention, the address of $FC01_H$ (the pixel data represented by $CA_H$) is illustrated in FIG. 5 and this address corresponds to the left margin of the discriminated bill 10.

Thereafter, the bill scale data selection means 191 supplies the addresses $00FF_H$, $01FF_H$, $02FF_H$, . . . $FFFF_H$, $00FE_H$, $00FE_H$, . . . successively into the data storage memory 160 and compares the pixel data supplied in the order of the these addresses with the digital slice value $40_H$. An address of the pixel data exceeding the slice value is $04FD_H$(pixel data represented by the $C8_H$) which corresponds to a right margin of the discriminated bill 10.

Then, the bill scale data selection meand 191 supplies addressed $0000_H$, $0001_H$, $0002_H$, . . . $00FF_H$, $0100_H$, $0101_H$. . . successively into the data storage memory 160 and compares the pixel data supplied in these order with the digital slice value $40_H$.

Successively, the bill scale data selection means 191 supplies addresses $00FF_H$, $01FF_H$, $02FF_H$, . . . $FFFF_H$, $00FE_H$, $01FE_H$ . . . sequentially into the data storage memory 160 and compares thus successively supplied pixel data with the digital slice value $40_H$. The address of the pixel data exeeding the slice value is $04FD_H$ (the pixel data represented by $C8_H$) which corresponds to the right margin of the discriminated bill 10.

Thereafter, the bill scale data selection means 191 supplies adresses $0000_H$, $0001_H$, $0002_H$, . . . $00FF_H$, $0100_H$, $0101_H$ . . . successively into the data storage memory 160 and compares thus successively supplied pixel data with the digital slice value $40_H$. The address of the pixel data exeeding the slice value is $0302_H$ (the pixel data represented by $BA_H$) which correspond to the front margin of the discriminated bill 10.

Finally, the bill scale data selection means 191 supplies adresses $FFFF_H$, $FFFE_H$, $FFFD_H$, . . . $FF00_H$, $FEFF_H$, $FEFE_H$ . . . sequentially into the data storage memory 160 and compares thus successively supplied pixel data with the digital slice value $40_H$. The address of the pixel data exeeding the slice value is $FDFC_H$ (the pixel data represented by $BF_H$) which correspond to the rear margin of the discriminated bill 10.

A storage address of the bill scale data can be decided on the basis of the appearance addreses of $FC01_H$, $04FD_H$, $0302_H$, $FDFC_H$.

Figure 6:
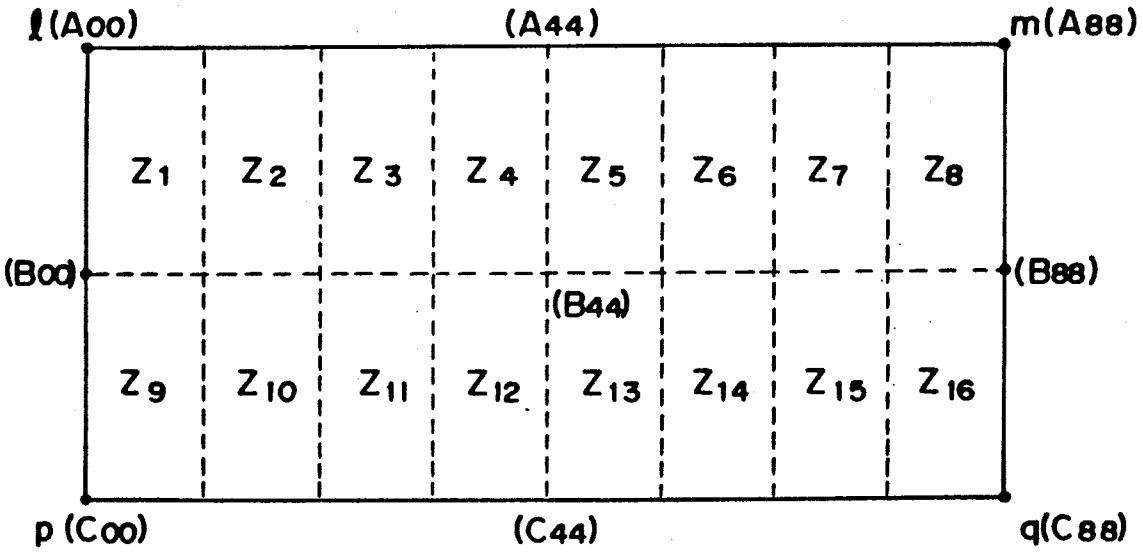
FIG. 6 is a view showing block areas of bill data.

These appearance addresses are supplied to the data segmenting means 192 in step S4, the data segmenting means 192 reads the division control program from the control data storage memory 161. That is, the data division means 192 difines, e.g. the address $0302_H$ as "l", the address $04FD_H$ as the "m", the address $FC01_H$ as "p" and the address $FDFC_H$ as "q" and decides the bill scale data as two demensional data of x and y. FIG. 6 represents the bill scale data as the two demensional data of x and y on the basis of the appearance addresses.

Since each address of "l ", "m", "p" and "q" is represented by two bytes, the data division means 192 divide these addresses into x-axis and y-axis in which the x-axis corresponds to the auxiliary scanning direction and the y-axis corresponds to the main scanning direction. For example, assume that l(H)=03 on the y-axis and (l) =02 on the x-axis since the address "l" is $0302_H$. Accordingly, m (H)=04 on the y-axis and m (l)=FD on the x-axis since the address "m" is $04FD_H$, while p (H) =FC on the y-axis and p (l)=01 on the x-axis since the address "p" is $FC01_H$, while q (H)=FD on the y-axis and q (l)=FC on the x-axis since the address "q" is $FDFC_H$.

Successively, the data split means 192 calculates each boundary address so as to divide the bill scale data into block areas on the basis of the following expressions. That is, a boundary address Axy for segmenting the addresses "l" and "m" into 8 divisions are represented by:

$$Ax=[\{(m(l)-l(l)\}/8]x\ x+l(l) \quad (1)$$

$$Ay=[\{(m(h)-l(h)\}/8]x\ y+l(h) \quad (2)$$

A boundary address Cxy for segmenting the address "p" and "q" into 8 divisions are represented by:

$$Cx=\{q(l)-p(l)\}/8x\ x+p(l) \quad (3)$$

$$Cy=\{q(h)-P(h)\}/8x\ y+p(h) \quad (4)$$

Addresses Bxy for segmenting the addresses "l", "p" and "m", "q" into two divisions are represented by:

$$Bx=(Ax-Cx)/2+Cx=Ax+Cx \quad (5)$$

$$By=(Cy-Ay)/2+Ay=Ay+Cy \quad (6)$$

If the scale data is segmented into 16 divisions based on the expressions (1) to (6) as set forth above, it is possible to divide these addresses into 16 block areas Z1 to Z16 as illustrated in FIG. 6. Accordingly, since the discriminated bill P has the face and back, it is possible to divide them into 32 block areas.

When the bill scale data is segmented into 16 block areas, the data operation means 193 calculates an average value of the bill scale data of the 16 segmented block areas Z1 to Z16. That is, the data operation means 193 reads the operation program from the control data storage memory 161 and supplies all the data included in the block area Z1 into the address selection circuit 170 and fetches the pixel data corresponding to the address of the data storage memory, i.e. segmented scale data, thereby calculates the average value of the segmented scale data $\overline{Z}n$ in the block areas Z1. That is, the average value Zn can be calculated by the following expression.

$$\overline{Z}n = \sum_{x=1}^{t} e(x)/t \quad (7)$$

where t is the number of pixels in the block area Z1 and e is the scale data in each pixel.

Likewise, the data arithmetic operation means 193 calculates the average values $\overline{Z}2$ to $\overline{Z}16$ of the other block areas Z2 to Z16 on the basis of the expression (7).

The thus obtained average values Z1 to Z16 of the block areas Z1 to Z16 are stored in the internal memory 194.

When the calculations of the average values Z1 to Z16 are completed, the bill decision means 195 fetches the standard average data from the standard data storage portion 161*a* of the control data storage memory 161. The standard average value data are obtained by segmenting faces and backs of each of a plurality of standard 10,000-yen bills, 5,000-yen bills, 1,000-yen bills in block areas in the same manner as set forth above, and calculating the average value in every two traveling direction. The standard average value data are previously stored in the standard data storage portion 161*a*. Accordingly, provided that the standard average value data is Skn, the expression k=12 and the expression n=1 to 16 are established since 3 denominations of bills are multiplied by 4, i.e. the face and back, and two traveling directions and one side of the bill is segmented into 16 block areas Z1 to Z16.

The bill decision means 195 converts the difference between the average value data S11 to S16 in each block area in a first pattern S1n of the standard average value data (e.g. the pattern obtained by the face of the 10,000-yen bill in one direction) and the average values $\overline{Z}1$ to $\overline{Z}16$ in each block area Z1 to Z16 of the discriminated bill P stored in the internal memory 194 into digital data, and thereafter calculates to obtain and absolute value of the difference. That is, the calculated average values $\overline{Z}1$ to $\overline{Z}16$ are converted into digital data D1 to D16 and the absolute values |S11−D1|, |S12−D2| . . . |S116−D16| of the difference between the digital data D1 to D16 and the average value data S11 to S116 are obtained.

FIG. 7 shows the result of arithmetic operations of these absolute values in which the absolute value is 5H at the block area n=1 in the pattern S1n, 7H at the block area n=2, AH at n=3, 4H at n=4, . . . , 2H at n=15 and CH at n=16.

Likewise, the bill decision means 195 calculates absolute values of the differences between the average value data in other patterns S2n, S3r, . . . S12n and the calculated average values.

Successively, the bill decision means 195 totals the absolute values in each of 12 patterns S1n to S12n. That is, the totaled value Gk in each pattern S1n to S12n can be obtained by the following expression.

$$Gk = \sum_{n=1}^{16} |Skn - Dn| \quad (8)$$

Finally, the bill decision means 195 compares each totaled value Gk in each pattern S1n to S12n and judges that the bill having the pattern of the least totaled value is the discriminated bill 10. That is, in FIG. 7 the bill represented by the S3n pattern is decided to be the denomination of bill in concern since the S3n pattern represented by Gk=7H is the least added value.

According to the first embodiment of the present invention, if the least totaled value Gk is greater than the predetermined range, the bill decision means 195 decides that the discriminated bill 10 is false.

Figure 8:
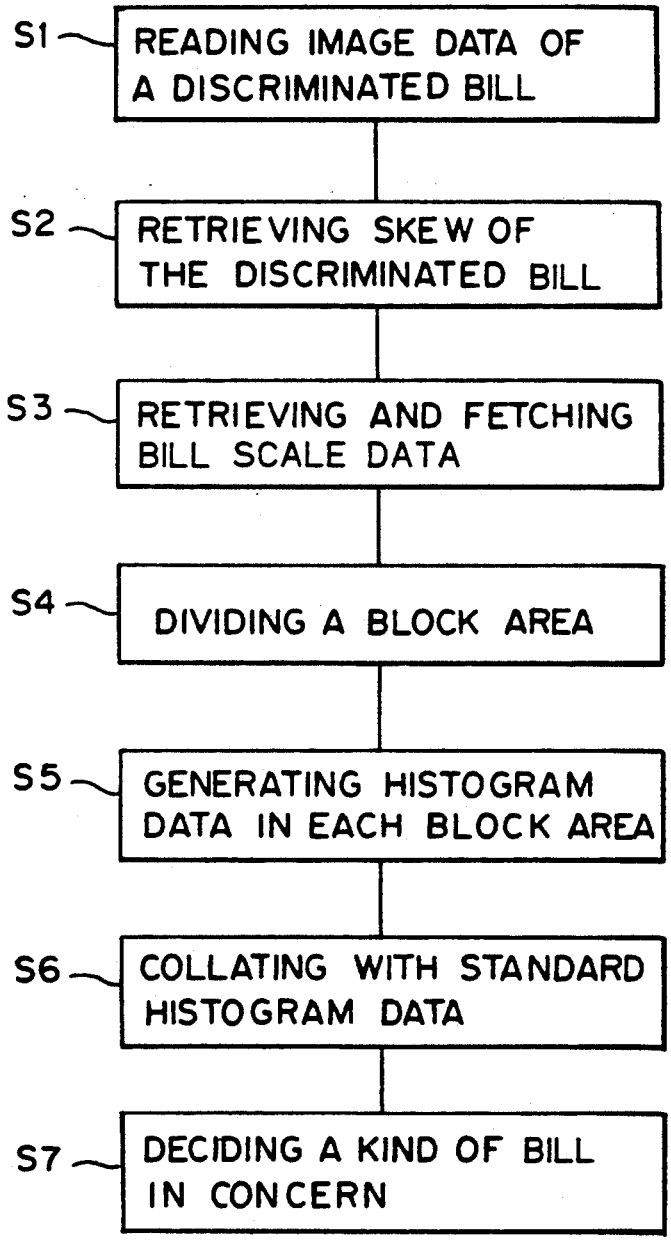
FIG. 8 is a flow chart showing an arithmetic operation of a bill discriminating apparatus for discriminating kins and traveling directions of the bill according to a second embodiment.
Figure 9:
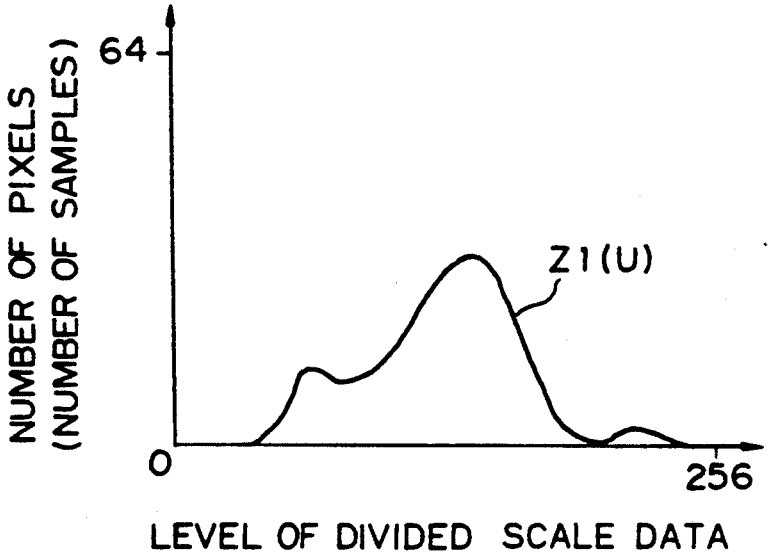
FIG. 9 is a histogram showing a frequency distribution.

Second Embodiment (FIGS. 8 to 10)

An operation of a bill discriminating apparatus according to a second embodiment of the present invention will be described with reference to FIGS. 8 to 10.

After the completion of the division of the scale data into the 16 block areas in steps S1 to S4, the data arithmetic means 193 processes the segmented scale data in each block area Z1 to Z16, thereby producing a histogram data (Step S5).

The histogram data is produced in the following manner.

The data operation means 193 reads the data process program from the control data storage memory 161. The data arithmetic means 193 supplies all the addresses included in the block area Z1 into the address selection circuit 170 and then fetches the pixel data corresponding to the address of the data storage memory 160, i. e. the segmented scale data.

The data arithmetic means 193 adds the numbers of samples, i.e. pixels in the segmented scale data of the same level provided that the levels of each segmented scale data in the block areas are populated and generates the histogram data by totaling data of the same level in each segmented scale data. Since each of the segmented scale data is composed of one byte, it can be represented by 256 population (the numbers of data). Accordingly, the numbers of the pixels corresponding to all the addresses in the block area Z1 are distributed in every segmented scale data level segmented into 256 sections for forming each histogram data. An entire histogram data (u) of the block area Z, is expressed as follows.

$$Zn(U)=\Sigma Hn\ (U{:}1, 2, 3, \ldots 256) \tag{9}$$

where H1 is each histogram data of the block and U (1, 2, 3, . . . 256) is levels of the segmented scale data.

FIG. 9 is a wave form showing a frequency distribution of the histogram data in the block area Z1 in which an x=axis shows the level of the segmented scale data and a y-axix shows the numbers of pixels.

Likewise, the data arithmetic means 193 produces the entire histogram data Zn (U) of the other block areas Z2 to Z16. The thus obtained entire histogram data Z1 to Z16 (U) of each block area Z1 to Z16 are stored in the internal memory 194.

Upon the completion of the production of the histogram data in every block area Z1 to Z16, the bill decision means 195 fetches the histogram data from the standard storage portion 161*a* of the control data storage memory 161. The standard histogram data is obtained by segmenting the face and the back of the plurality of the standard 10,000-yen bill, 5,000-yen bill and 1,000-yen bill into the 16 block areas in every two directions and it is previously stored in the standard data storage portion 161*a*. Accordingly, provided that the pattern of the standard histogram data is Skn, the equation k=12 is established by the face and the back of three denominations of bills in two traveling directions. Since n is segmented into 16 block area Z1 to Z16, the equation n=1 to 16 is established.

The bill decision means 195 calculates the absolute values of the differences between the histogram data S11 (U) to S116 (U) each corresponding to the first pattern S1n of the standard histogram data (e.g. the pattern obtained by scanning the face of the 10,000-yen bill in one direction) and the entire histogram data Z1 (U) to Z16(U) in each block area Z1 to Z16 of the discriminated bill 10 stored in the internal memory 194. That is, each histogram data of the thus obtained entire histogram data Z1 (U) to Z16 (U) is converted into digital value data D1 to D256 and the absolute data values |T1−D1|, |T2−D2|, . . . |T256−D256| are calculated. While T1 to T256 are histogram data of the entire histogram data S22(U) to S116(U) of the pattern S1.

Successively, the bill decision means 195 adds the absolute values |T1−D1|, |T2−D2|, . . . ,|T256−D256|. That is, the following expression is established.

$$Zk(n) = \sum_{u=1}^{256} R(U) \tag{10}$$

where Zk(n) is a total added value in each block area and R(U) is the absolute value of the difference.

Furthermore, the bill decision means 195 totals Zk(1) to Zk(16), sums of every block area Z1 to Z16 in 12 patterns S1n to S16n which are decided by the type of the discriminated bill, the traveling direction and the face or back of the note.

$$Dk = \sum_{n=1}^{16} Zk(n) \tag{11}$$

FIG. 10 shows a totaled value Zk(n) of the absolute value of the difference between each histogram data D1 to D256 in the block area Zn relative to the pattern Skn (e.g. an equation of Z1(1)=598$_H$ is established) and the decided value Gk of the pattern Skn (e.g. a decided vlaue of S1n becomes 1765$_H$).

Finally, the bill decision means 195 compares the decision values Dk of each pattern S1n to S12n with each other and decides that the bill having the least decision value Dk is the discriminated bill 10. For example, in FIG. 10, D3=27A$_H$ is the least decision value, hence k=3 is decided to be the corresponding type and the traveling direction of the discriminated bill 10.

As a first modification of the second embodiment, it is possible to integrate the segmented scale data in each block area Z1 to Z16 by the data arithmetic means 193. In this case, the standard integral value data is previously stored in the standard storage portion 161*a*. The standard integral data can be experimentally obtained by the plurality of standard bills. There are 12 patterns (S1 to S12) as the standard integral value data depending on the denomination of the bills (three denominations in Bank of Japan note), the traveling directions (two direcitons), the face and the back of the bill which are obtained by segmenting one side of the bill into 16 block areas and calculating the integral values in each block area. The bill decision means 195 calculates the absolute value of the difference between the integral value data in each block area for every standard pattern S1 to S12 and the calculated integral value in each block area, thereby detecting the minimum totaled value of the absolute value. The pattern representing the minimum value is decided to be the type and the traveling direction of the discriminated bill.

As another modification of the second embodiment, the segmented scale data is integrated by the data arithmetic means 193 in each block area Z1 to Z16 in the same manner as the first modification. The bill decision means 195 reads the weight data previously stored in the standard data storage portion 161a and totals the weight data and the totaled value in each block area to the integral value calculated in each block area. The totaled value Gk is expressed as follows.

$$Gk = \sum_{n=1}^{16} Skn \times Wkn \quad (12)$$

where S represents integral values calculated in each block area, W represents the weight data, k (k=12) is the numbers to be decided by the denomination of bill, the traveling direction of the bill and the face and back of the bill, and n (n=16) is the number of the block area.

The bill decision means 195 selectes the resultant maximum totaled value based on which the denomination, traveling direction and the face and back of the bill are decided.

A weight data is decided by segmenting the face and the back of the plurality of standard 10,000-yen bill, 5,000-yen bill and 1,000-yen bill in every block area, thereby extracting segmented scale data of a large level in each block area and setting the largest numeral value at the extracted portion.

Although one side of the discriminated bill is segmented into the block areas Z1 to Z16 to thereby discriminate the types of bills and the traveling directions according to first embodiment of the present invention, it is a matter of course to divide both the face and the back of the discriminate bill 10 into the block areas to thereby discriminate the types of bill. In the later case, the sensors 20 are respectively vertically disposed relative to the traveling direction of the note.

The block area is segmented into 16 portions but it may be segmented into less than 16 portions.

Although the sensor 20 is copmosed of image sensor 103 of the reflection type, it may be composed of image sensors of a transparent type, or magnetic sensors which have the same effect as the former.

Figure 11:
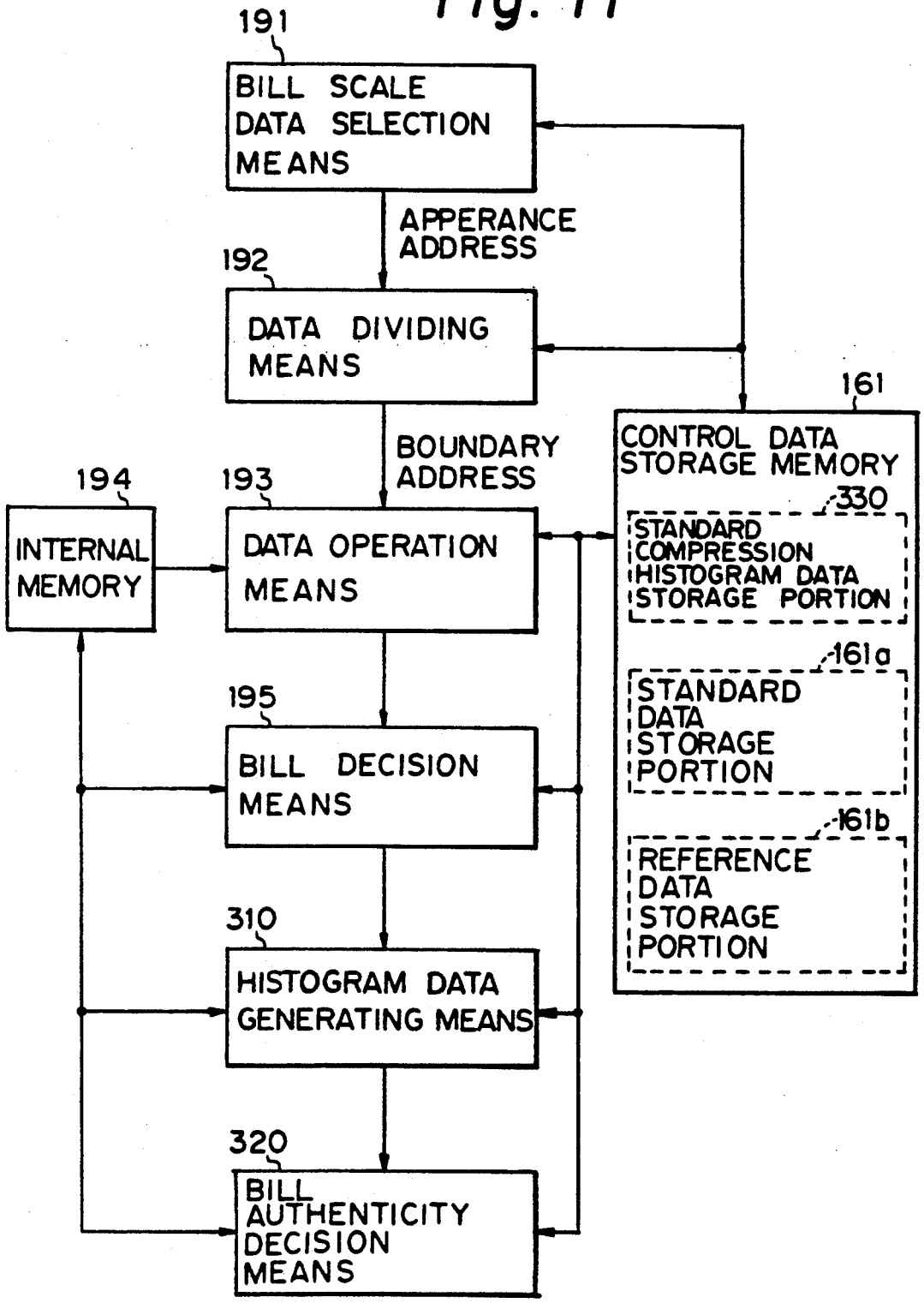
FIG. 11 is block diagram of the bill discriminating apparatus for discriminating authenticity of the bill according to a third embodiment of the present invention.
Figure 12:
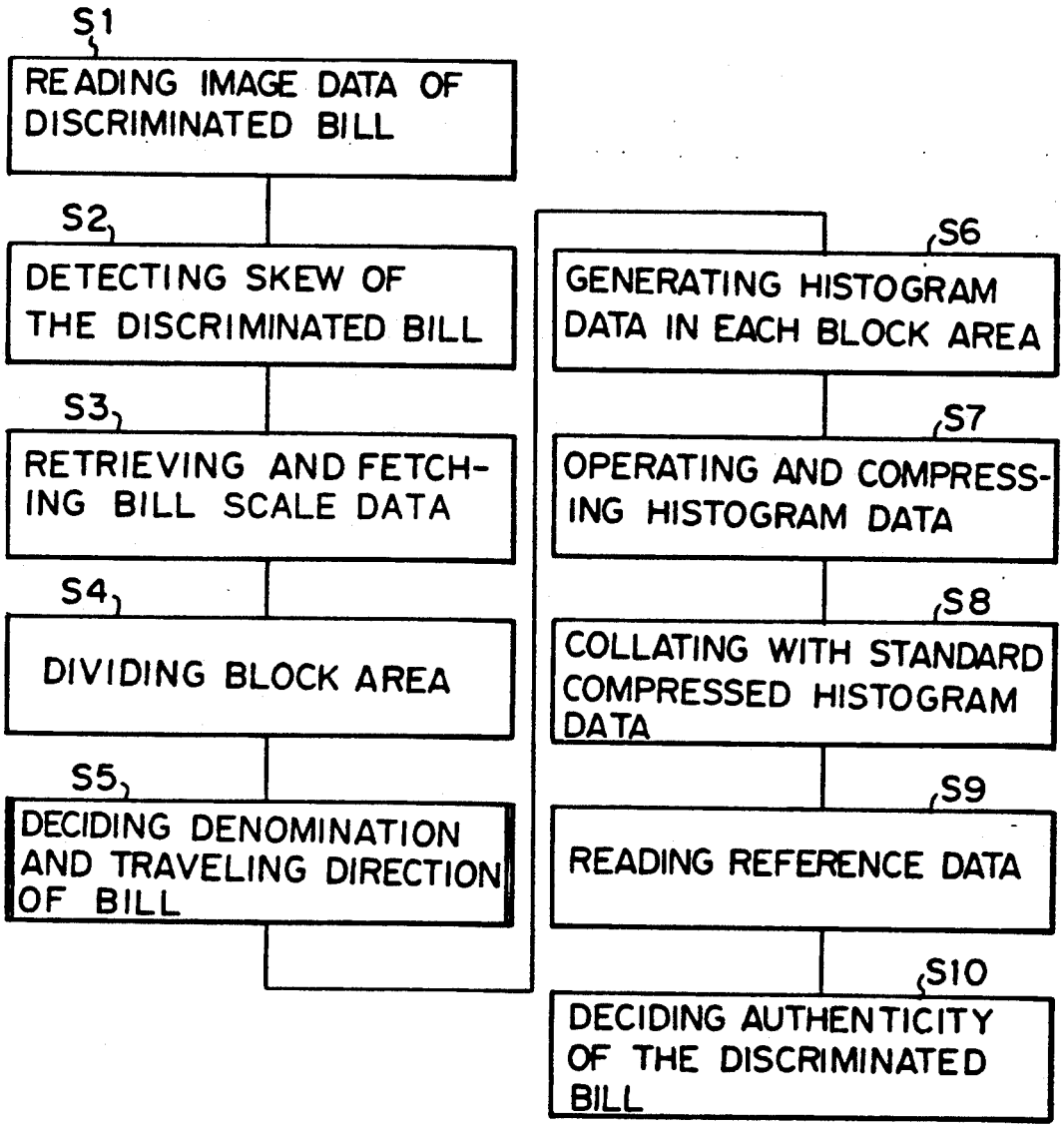
FIG. 12 is a flow chart showing an operation of the bill discriminating apparatus in FIG. 11.

Third Embodiment (FIGS. 11 and 12)

A bill discriminating apparatus according to a third embodiment of the present invention will be described with reference to FIGS. 11 and 12.

When the type of bill and the traveling direction of the bill is decided by one of four methods set forth above, the histogram generator 310 processes the segmented scale data in each block area Z1 to Z16 fetched by the data operation means 195, thereby generating an entire histogram data Z1(U) to Z16(U) composed of the histogram data H (U=1, 2, . . . 256). The method of generation of the histogram data is the same as that as set forth in the decision of the types of bill and the traveling direction. The thus generated histogram data Z1(U) to Z16(U) are stored in the internal memory 194.

Upon the completion of the generation of the histogram data, a bill authenticity decision means 320 reads the entire histogram data Z1(U) to Z16(U) in each block area Z1 to Z16 from the internal memory 194 and performs an operation (Step S5). That is, a normalized operation data En(U) is expressed as follows.

$$En(U)=\{Hn(U)-Hn(min)\}x\{Hn(max)-Hn(min) \quad (13)$$

where Hn(U) is each histogram data, Hn(min) is a minimum value of the histogram data, and Hn(max) is a maximum value of the histogram data.

When the bill authenticity decision means 320 completes the operation of the normalized operation data En(U) in each block area Z1 to Z16, the bill authenticity decision means 320 carries out data compression of the arithmetic data En(U) on the basis of the following expression.

$$Ln(X)=M/4 \quad (14)$$

where Ln (hereinafter referred to as compression histogram data) is the normalized operation data which compresses the normalized arithmetic data En(U) and M represents the maximum value the apparatus can read. The maximum value M is determined by a conversion capacity of an A/D converter 130. According to the third embodiment of the present invention, since the A/D converter 130 having 8 bit processing capacity, an equation M=256 is established and the normalized operation data En(U) is compressed to ¼.

Figures 13, 14:
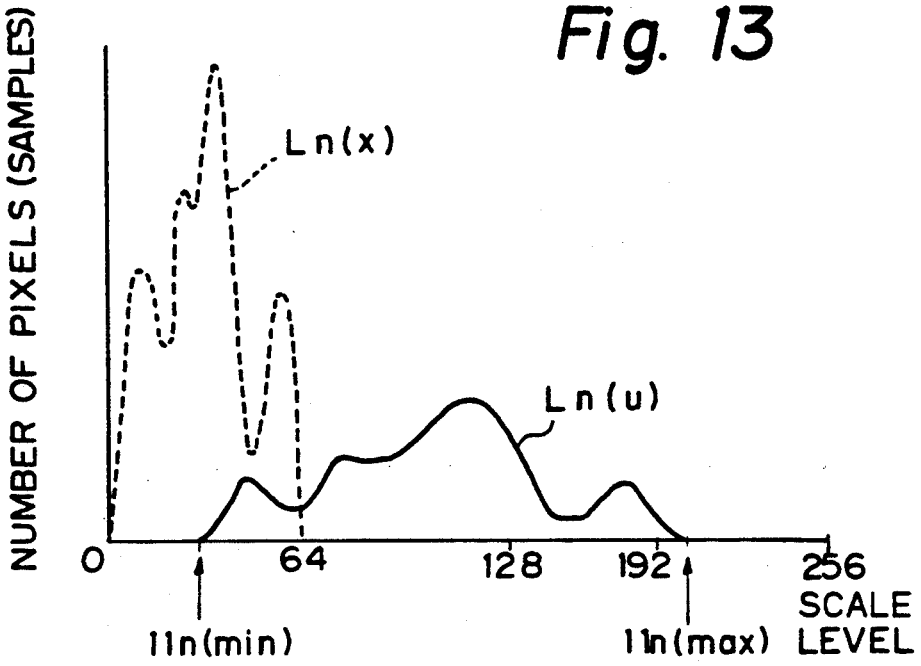
FIG. 13 is a histogram showing a frequency distribution according to a fourth embodiment.
FIG. 14 is a view showing an arithmetic result in every block area.
Figure 15:
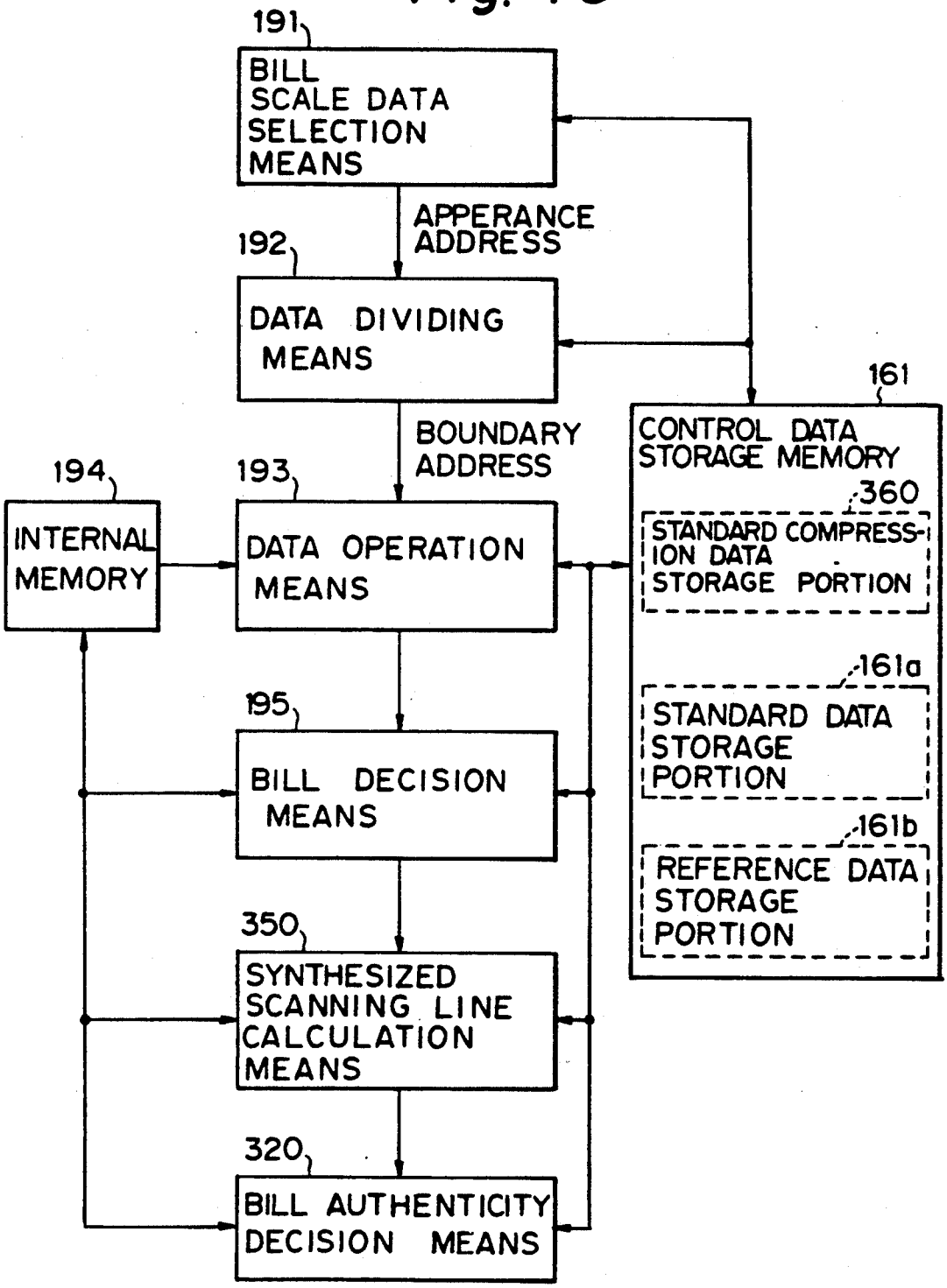
FIG. 15 is a block diagram of the bill discriminating apparatus for discriminating authenticity of the bill according to a fifth embodiment of the present invention.

Fourth Embodiment (FIGS. 13 and 14)

A solid line in FIG. 13 shows a frequency distribution of the normalized arithmetic data En(U)(U=1, 2, 3, . . . 256) and a dotted line shows a compressed histogram data Ln(X) (X=1, 2, 3, . . . 64) compressed to ¼.

When the data compression is completed, the bill authenticity decision means 320 fetches a standard compressed data corresponding to types of bill, traveling direction decided by the bill decision means 195 from a standard compressed histogram data storage portion 330 of the control data storage memory 161 (Step S8). The standard compressed histogram data is obtained by segmenting the face and the back of a plurality of a standard 10,000-yen bill, 5.000-yen bill and 1,000-yen bill into 16 blocks and calculated in every traveling directions on the basis of the expressions (13) and (14). Accordingly, provided that the pattern of the standard compressed histogram data is Skn, the type and traveling direction of the bill are expressed as k=12 and the number of block area is expressed as n=16.

The bill authenticity decision means 320 obtains an absolute value of the difference between the standard compressed histogram data P31 (X) to P316(X) in the pattern S3n having the type and traveling direction decided by the bill decision means 195 (e.g. the pattern obtained by 10,000-yen note) and the compressed histogram data L1 (X) to L16(X) of the discriminated bill P in each block area Z1 to Z16 stored in the internal memory 194. That is, the absolute value of the difference is expressed as |P31(X)−L1(X)|, |P32(X)−L2(X)|, . . . |P316(X)− L16(X)|.

Successively, the bill authenticity decision means 320 totals these absolute values in each block area, namely it is expressed as follows.

$$R3n = \sum_{x=1}^{64} |P3n(X) - Ln(X)| \quad (15)$$

where R3n represents the totaled value of the absolute value.

FIG. 14 shows the resultant total R3n of the absolute value in each block area Z1 to Z16 in which the equation R31=138$_H$ in the block area Z1 the equation $R32=194_H$ in the block area Z2 . . . and the equation $R316=157_H$ in the block area Z16 are established.

Thereafter, the bill authenticity decision means 320 reads a standard data T3n corresponding to the pattern S3n of the bill from the standard data storage portion 161b of the control data storage memory 161 (Step 9). The bill authenticity decision means compares the standard data with the total R3n in each block area Z1 to Z16 and decides that the discriminated bill 10 is genuine if it decides that all the totals R3n are less than the standard data T3n.

If one of the totals R3n is decided to be greater than the standard data T3n, the bill authenticity decision means 320 decides that the discriminated bill 10 is false.

Fifth Embodiment (FIGS. 15 to 19)

A bill discriminating apparatus according to a fourth embodiment of the present invention will be described with reference to FIGS. 15 to 19.

Figure 16:
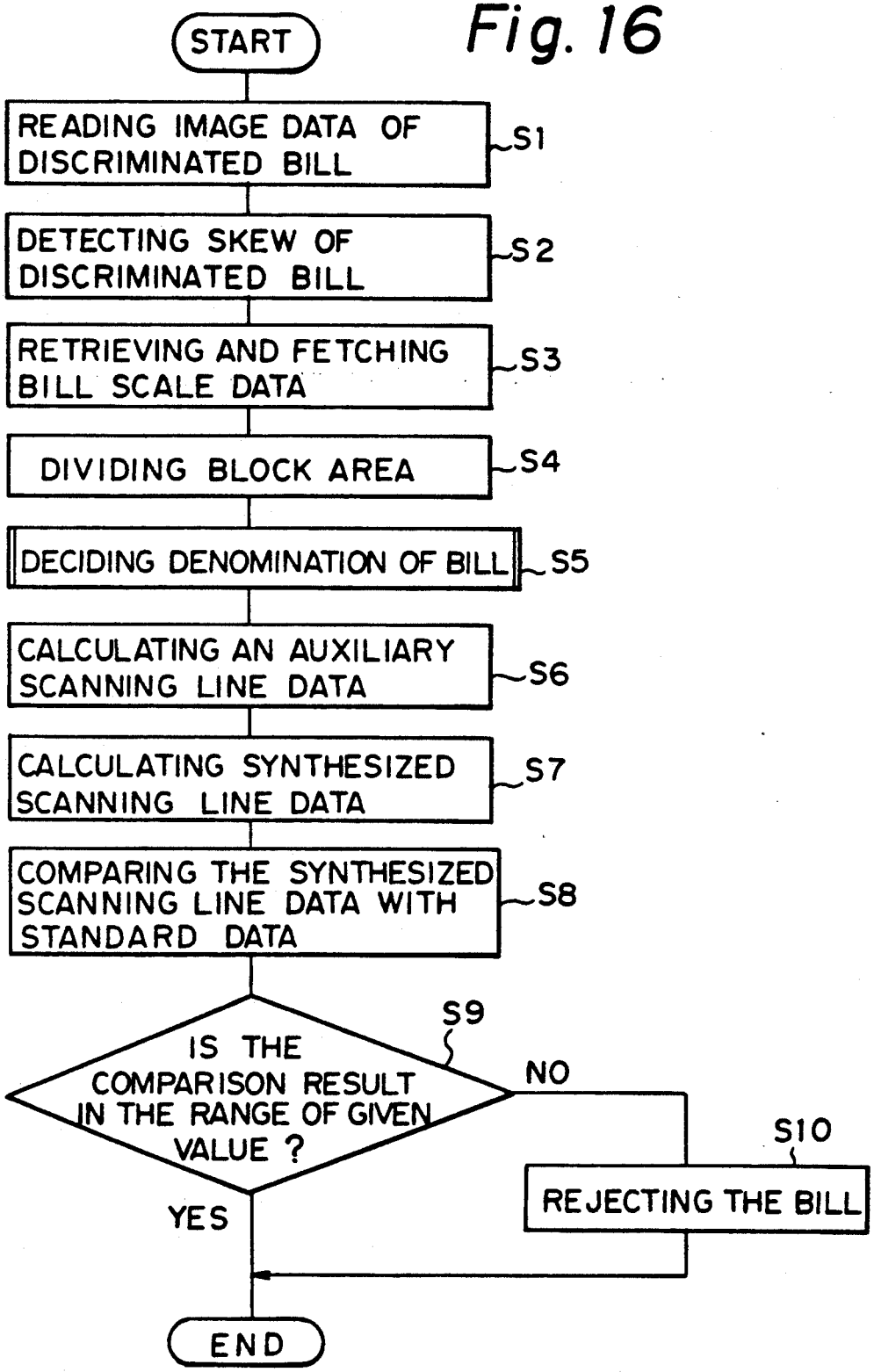
FIG. 16 is a flow chart showing an arithmetic operation of the bill discriminating apparatus in FIG. 15.

An auxiliary scanning data is calculated from merely the data fetched in the step S3 of FIG. 16 (Step S6).

Figure 17:
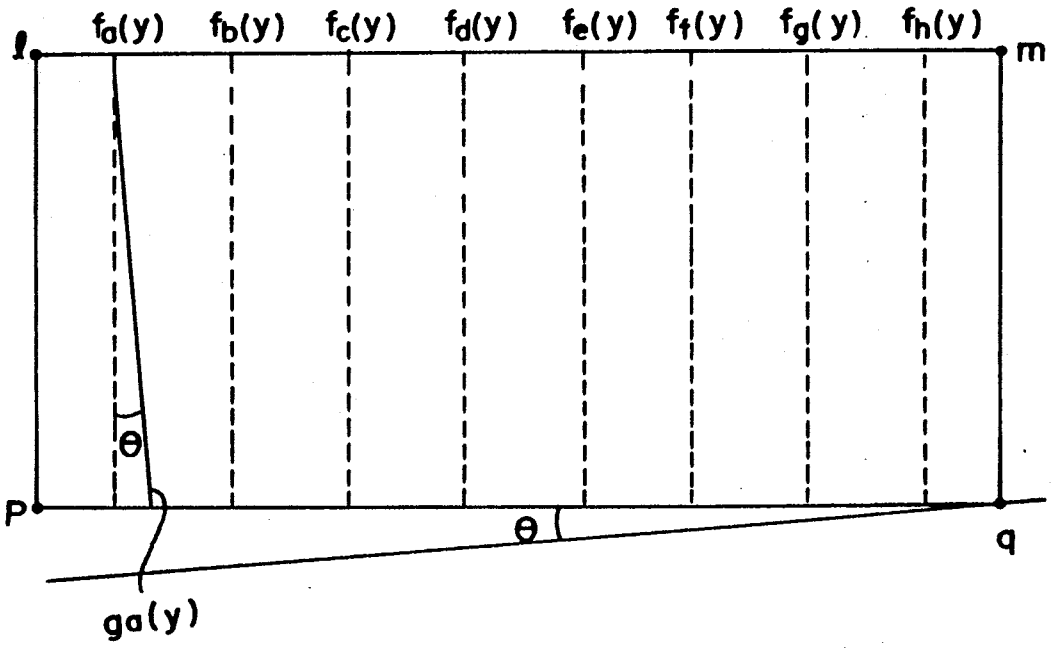
FIG. 17 is a view showing scanning lines.

As illustrated in FIG. 17 showing the auxiliary scanning data, tracks of $f_a(y)$ to $f_h(y)$ can be calculated by the cut data. In this case, the auxiliary scanning data can be obtained not by the auxiliary scanning line but by compensating the amount of the skew traveling direction of the bill. That is, the skewed $F_a(y)$ is expressed as follows.

$$f_a(y)=g_a(y)\{1-\sin\theta\} \quad (16)$$

$g_a(y)$ is a data scanned by the auxiliary line in the sensor 100.

Successively, synthesized scanning line calculation means 350 synthesizes a plurality cf scanning lines adjoining auxiliary scanning data $f_a(y)$ to $f_h(y)$ calculated by the step S6 and calculates the synthesized scanning line data in each auxiliary scanning line (Step S7).

According to the fifth embodiment of the present invention, the synthesized scanning line data is calculated by five scanning lines which are expressed as follows.

$$f'_a(y)=f_{a-2}(y)+f_{a-1}(y)+f_a(y)+f_{a+1}(y)+f_{a+2}(y) \quad (17)$$

That is, the synthesized scanning line data of the auxiliary scanning line data $f_a(y)$ to $f_h(y)$ is expressed as $f'_a(y)$ to $f'_h(y)$.

Thereafter, the bill authenticity decision means 320 compares the synthesized scanning line data $f'_a(y)$ to $f'_h(y)$ calculated in the step of S7 with the standard synthesized auxiliary scanning line data stored in the standard synthesized scanning data 360 of the control data storage memory 161 (Step S10). A resultant arithmetic operation of the comparison are expreseed as follows.

$$S_a=\sum_{y=1}^{r}|T_a(y)-f_a'(y)| \quad (18)$$

$$S_h=\sum_{y=1}^{r}|T_h(y)-f_h'(y)| \quad (19)$$

where standard patterns $T_a(y)$ to $T_h(y)$ correspond to synthesized scanning data $f'_a(y)$ to $f'_h(y)$ and r represents a terminal end of the auxiliary scanning direction of the note.

Successively, the bill authenticity decision means 320 decides that the resultant operation $S_a$ to $S_h$ calculated in the step S10 are within predetermind values or not so as to decide the authenticity of the discriminated bill (Step S11). FIGS. 18 and 19 are tables showing the result of decision in which FIG. 18 shows that the bill is decided to be genuine and FIG. 19 shows that the bill is decided to be false.

That is, the bill authenticity decision means 320 decides that each of the arithmetic operation of result $S_a$ to $S_h$ is less than the predetermind value and that the bill is genuine only in the case that all the resultant arithmetic operations $S_a$ to $S_h$ are within the predetermind value. If the bill is decided to be false in step S11, the bill is rejected by a discharge mechanism, not shown (Step S12).

Eight auxiliary scanning line data are calculated and the synthesized scanning line data are calculated from five scanning line data in each auxiliary line data according to the fourth embodiment of the present invention. However, the number of auxiliary scanning line data is not limited thereto but selectable appropriately.

Although the synthesized scanning line data is calculated by adjoining scanning line data, it may be calculated by scanning line data which are not adjoining one another.

The traveling direction of the bills can be discriminated by segmenting the plurality of block areas while the denomination of bills can be discriminated by the method of synthesized scanning line data.

What is claimed is:

1. A bill discriminating apparatus comprising:

sensor means for scanning and reading all the printed patterns of a bill to be discriminated, and producing discriminated data including bill scale data, the bill scale data representing the density of the printed patterns;

a data storage memory of restoring the discriminated data including the bill scale data from the sensor means;

bill scale data selection means for selecting the bill scale data from the discriminated data and fetching the selected bill scale data from the data storage memory;

data segmenting means for segmenting the thus selected and fetched bill scale data into a plurality of blocks of data;

data arithmetic means for subjecting the segmented bill scale data to an arithmetic averaging process for each block of data;

reference data storage means for storing reference data therein for each of a plurality of predetermined reference bills; and bill decision means for reading each reference data from the reference data storage means and comparing each block of the bill scale data which was subjected to an arithmetic averaging process with each reference data.

2. A bill discriminating apparatus according to claim 1, wherein the bill scale data selection means compares the discriminated data with a given slice value, and fetches discriminated data having a value greater than the slice value as the bill scale data.

3. A bill discriminating apparatus according to claim 2, wherein the bill scale data selection means selects addresses representing four corners of the bill to be discriminated, among the fetched bill scale data.

4. A bill discriminating apparatus according to claim 1, wherein the data arithmetic means calculates average values of segmented bill scale data in each block, wherein the reference data storage means holds reference average data as each reference data for each of the plurality of reference bills, and wherein the bill decision means determined for each block the absolute value of the difference between each reference average data and the segmented bill scale data average value, and determines the least of the absolute values, corresponding to the discriminated bill.

5. A bill discriminating apparatus according to claim 1, wherein the data arithmetic means processes the segmented bill scale data for each block and generates histogram data, wherein the reference data storage means holds reference histogram data as each reference data for every bill, and wherein the bill decision means compares the thus generated histogram data with the reference histogram data and subjects the compared data to an arithmetic process to thereby decide the denomination of the bill.

6. A bill discriminating apparatus according to claim 1, wherein the data arithmetic means integrates the segmented bill scale data for every block and produces integral data, wherein the reference data storage means holds reference integral data as each reference data, and wherein the bill decision means totals an absolute value of the difference between each reference integral data for every bill and the thus obtained integral data to thereby decide that the bill corresponding to the reference integral data which results in the least totaled absolute value is the discriminated bill.

7. A bill discriminating apparatus according to claim 1, wherein the data arithmetic means integrates the segmented bill scale data for every block and produces integral data, wherein the reference data storage means holds weight data for every bill, and wherein the bill decision means subjects both the weight data and the thus obtained integral data to the arithmetic averaging process and totals values for every block area to thereby decide that the bill associated with the largest totaled value is the discriminated bill.

8. A bill discriminating apparatus according to claim 1, wherein the data segmenting means segments the selected and fetched bill scale data into 16 blocks.

9. A bill discriminating apparatus comprising:

sensor means for reading all the printed patterns of a bill to be discriminated and producing discriminated data including bill scale data, the bill scale data representing the tone of the printed patterns;

a data storage memory for storing the discriminated data including bill scale data detected by the sensor means;

bill scale data selection means for selecting the bill scale data from the discriminated data and fetching the selected bill scale data from the data storage memory;

data segmenting means for segmenting the thus selected and fetched bill scale data into a plurality of blocks of data;

data arithmetic means for subjecting the segmented bill scale data to an averaging process in each block;

first standard data storage means for storing respective standard data therein for each of a plurality of predetermined notes;

bill decision means for reading each standard data from the first standard data storage means and comparing the segmented bill scale data which was subjected to the arithmetic averaging process in each block with each standard data and producing bill denomination information;

histogram data generating means for processing the segmented bill scale data in every block to generate histogram data;

second standard data storage means for storing predetermined histogram data therein for each of the plurality of predetermined notes; and bill authenticity decision means for reading the standard histogram data from the second standard storage means on the basis of bill denomination information from the bill decision means and comparing the histogram data in every block area with the standard histogram data to thereby decide the authenticity of the bill to be discriminated.

10. A bill discriminating apparatus according to claim 9, wherein the bill authenticity decision means includes data compression means for compressing the histogram data in every block and for compressing the standard histogram data.

11. A bill discriminating apparatus comprising:

sensor means for reading all the printed patterns of discriminated bill and producing discriminated data, including bill scale data representing the tone of the printed patterns;

a data storage memory for storing the discriminated data including the bill scale data detected by the sensor means;

bill scale data selection means for selecting the bill scale data from the discriminated data and fetching the selected bill scale data;

data segmenting means for segmenting the thus selected and fetched bill scale data into a plurality of blocks;

data operation means for subjecting the segmented bill scale data to an arithmetic averaging process in each block;

first standard data storage means for storing standard operation data therein for each of a plurality of predetermined notes;

bill decision means for reading each standard operation data from the first standard data storage means and comparing the segmented bill scale data which was subjected to the arithmetic averaging process in each block with each standard operation data and producing bill denomination information;

synthesized scanning line operation means for synthesizing one scanning line data in a plurality of scanning line data to thereby obtain synthesized scanning line data;

second standard data storage means for storing predetermined standard synthesized scanning line data for each of the plurality of predetermined notes; and bill authenticity decision means for reading standard synthesized scanning line data on the basis of the bill denomination information produced by the bill decision means, from the second standard data storage means, and comparing the synthesized scanning data calculated by the synthesized scanning line operation means with the standard synthesized scanning line data to thereby decide the authenticity of the bill to be discriminated.

12. A bill discriminating apparatus according to claim 11, wherein the synthesized scanning line operation means synthesizes a plurality of adjoining scanning line data.

13. A method of discriminating a bill in a bill discriminating apparatus comprising sensor means for reading all the printed patterns of a discriminated bill and producing discriminated data including bill scale data representing the tone of the printed patterns, and a data storage memory for storing the discriminated data including bill scale data produced by the sensor means, the method comprising the steps of:

selecting and fetching the bill scale data from the data storage memory with bill scale data selection means;

segmenting the thus fetched bill scale data into a plurality of block areas with data segmenting means;

subjecting the segmented bill scale data to an arithmetic averaging process each block area with data arithmetic means; and comparing the segmented bill scale data which was subjected to an arithmetic averaging process in each block area with standard operation data for each of a plurality of bills previously determined, with bill decision means.

* * * * *